US008469197B2

(12) United States Patent
Gupta et al.

(10) Patent No.: US 8,469,197 B2
(45) Date of Patent: Jun. 25, 2013

(54) BLENDED FROTHER FOR PRODUCING LOW ASH CONTENT CLEAN COAL THROUGH FLOTATION

(75) Inventors: Ashiwani K. Gupta, Jamshedpur (IN); Pradip Kumar Banerjee, Jamshedpur (IN); Debashish Bhattacharjee, Jamshedpur (IN)

(73) Assignee: Tata Steel Limited, Jamshedpur (IN)

( * ) Notice: Subject to any disclaimer, the term of this patent is extended or adjusted under 35 U.S.C. 154(b) by 809 days.

(21) Appl. No.: 12/596,514

(22) PCT Filed: Aug. 19, 2008

(86) PCT No.: PCT/IN2008/000519
§ 371 (c)(1),
(2), (4) Date: Dec. 8, 2009

(87) PCT Pub. No.: WO2010/020994
PCT Pub. Date: Feb. 25, 2010

(65) Prior Publication Data
US 2010/0181520 A1 Jul. 22, 2010

(51) Int. Cl.
*B03D 1/008* (2006.01)
*B03D 1/02* (2006.01)

(52) U.S. Cl.
USPC ..... 209/166; 252/61

(58) Field of Classification Search
USPC ..... 252/61; 209/166
See application file for complete search history.

(56) References Cited

U.S. PATENT DOCUMENTS

| | | | | | |
|---|---|---|---|---|---|
| 2,300,827 | A | * | 11/1942 | Christmann et al. | 209/166 |
| 2,721,657 | A | * | 10/1955 | Meyer et al. | 209/166 |
| 2,927,691 | A | * | 3/1960 | Chapman et al. | 209/166 |
| 3,710,939 | A | | 1/1973 | Hostynek et al. | |
| 4,272,364 | A | | 6/1981 | Dixon et al. | |
| 4,504,385 | A | | 3/1985 | Keys | |
| 4,582,596 | A | | 4/1986 | Hansen et al. | |
| 4,584,095 | A | * | 4/1986 | Unger | 209/166 |
| 4,606,818 | A | | 8/1986 | Keys | |
| 4,761,223 | A | | 8/1988 | Klimpel et al. | |
| 4,820,406 | A | * | 4/1989 | Hansen et al. | 209/166 |
| 4,915,825 | A | | 4/1990 | Christie et al. | |
| 4,925,559 | A | | 5/1990 | Biermann et al. | |
| 5,304,317 | A | | 4/1994 | Barwise et al. | |
| 8,123,042 | B2 | * | 2/2012 | Tran | 209/166 |
| 2008/0308467 | A1 | * | 12/2008 | Tran | 209/166 |

OTHER PUBLICATIONS

International Search Report of PCT/IN2008/000519, filed on Aug. 19, 2008.

* cited by examiner

*Primary Examiner* — Thomas M Lithgow
(74) *Attorney, Agent, or Firm* — Venable LLP; Keith G. Haddaway

(57) ABSTRACT

An improved frothing agent adaptable to froth flotation process to enhance coal selectivity for separation and efficiency of the froth flotation process comprises:

| A blended mixture of | |
|---|---|
| Ketone (2,6-Dimethyl-4-Heptanone) | 85-89% (Wt %) |
| Ester molecule(Tetrahydrofurfuryl acetate) | 10-12% (Wt %) |
| Epoxide conditioner (1,2-Epoxydodecane) | 0.25-0.30% (Wt %) |
| Water | 4.75-5.25% (Wt %) |

9 Claims, 2 Drawing Sheets

| | | | | |
|---|---|---|---|---|
| Size feed ash% | 22 | 23 | 21 | 22 |
| Size feed wt% | 10 | 46 | 14 | 30 |

| Chemicals | Structure | Wt% in mixed frother |
|---|---|---|
| 2,6-Dimethyl-4-Heptanone |  | 85-89% |
| Tetrahydrofurfuryl acetate |  | 10-12% |
| 1,2, epoxydodecane |  | 0.25-.30% |
| Water |  | 4.75-5.25% |

BLENDED FROTHER FOR PRODUCING LOW ASH CONTENT CLEAN COAL THROUGH FLOTATION

FIELD OF THE INVENTION

The present invention relates to the froth flotation of finely divided coal particles for separation of ash from carbon. Particularly, the present invention relates to an improved frothing agent adaptable to froth flotation process to enhance efficiency of the froth flotation process and coal selectivity.

BACKGROUND OF THE INVENTION

In the coal industry, various types of shale and clay are produced as a mixture with the coal, to increase the heating value of the coal and to reduce the hauling costs, a complex process of coal washing is normally used to reduce the total ash content. In this process the coal is graded to a certain size, usually less than 15 mm and greater man ½ mm and then fed into a dense medium cyclone.

The usual practice for separation of fine particles (less than ½ mm) of coal contained in coal slurry through the use of froth flotation processes is well known. Froth flotation processes involve introducing air into the coal slurry. The hydrophobic particles of coal are contacted with finely disseminated air bubbles such that the fine air bubbles become adhered to the hydrophobic coal particles.

The particles carrying bubbles are then permitted to rise, forming froth on the surface of the slurry. The froth, containing the hydrophobic particles of coal, is skimmed from the surface of the coal slurry and collected, while rejecting any hydrophilic particles of impurities which don't adhere to the air bubbles and which remain suspended in the slurry.

Flotation of coal fines has become increasingly important as a separation and cleaning process where there is lowering in both the particle size and grade of the coal being recovered from mining operation. The ability to remove the coal fines from coal washery or tailings is also advantageous in order to recover coal fines missed by other techniques of coal recovery.

In order to improve the selectivity and recovery of the flotation process and enhance floating of the coal fines, various types of reagent have been developed for addition to the slurry. Frothers and collectors are two types of reagents which are commonly used in coal flotation. A frothing agent is utilized to provide stable flotation froth persistent enough to facilitate the coal separation but not so persistent that it cannot be broken to allow subsequent handling.

The use of froth flotation to effect a separation of ash particles from coal can be achieved only if liberation of these unwanted particles form the coal has taken place, Most high-grade coals are flotable naturally due to their hydrophobic surface and typically only require a frothing agent for effecting flotation. A frothing agent imparts elasticity to the air bubbles, enhances particle-attachment so that the coal is buoyed to the surface of the slurry.

Conventional frothers can be essentially divided into four groups. The first group consists of aromatic alcohols such as α-eresol and 2,3-xylenol. A second group is the alkoxy types such as triethoxy butane (TEB). The third group consists of aliphatic alcohol such as 2-ethyl hexanol, diacetone and methyl isobutyl carbinol (MIBC). In recent years, a fourth group of synthetic frothers consisting of PEO (polyethylene oxide), PPO (polypropylene oxide) and PBO (polybutylene oxide) types have been introduced into the market. These chemicals may be presented by the general equation; R $(X)_nOH$ where R=H or $C_nH_{2n+1}$ and X=EO, PO or BO.

General problems associated with the conventional frothing agents and recent developed frother are I) Not effective for both coarse and ultrafine particles for wide size distributed flotation feed (0.5×0.0 mm). It is due to some frothers are effected for coarse particles and others are good for floating ultra fine fractions, II) Incapability of producing low ash content clean coal form highly ash mineral particle disseminated and difficult to float type of coal like Indian coal. Examples of patents directed at improved frothers include U.S. Pat. No. 4,582,596 issued Apr. 15, 1986, U.S. Pat. No. 4,915,825 issued Apr. 10, 1990. U.S. Pat. No. 4,272,364 issued Jun. 9, 1981, U.S. Pat. No. 4,504,385 issued Mar. 12, 1985, U.S. Pat. No. 5,304,317 issued Apr. 19, 1994, U.S. Pat. No. 3,710,939 issued Jan. 16, 1973, U.S. Pat. No. 4,606,818 issued Aug. 19, 1986, U.S. Pat. No. 4,761,223 issued Aug. 2, 1988, U.S. Pat. No. 4,925,559 issued May 15, 1990. Therefore, the present inventors have developed a frother which comprises ketone and ester functional group with a small quantity of conditioning agent. This novel frother overcomes the many disadvantages of the aforementioned conventional and earlier invented frothers, as well as provide the following advantages: increased clean coal recovery with better selectivity, a frother having both frother and collector properties when used in coal flotation processes.

OBJECTS OF THE PRESENT INVENTION

It is therefore, an object of the present invention to propose an improved frothing agent adaptable to froth flotation process to enhance the efficiency of forth flotation process and coal selectivity which eliminates the disadvantages of prior art.

another object of the present invention is to propose an improved frothing agent adaptable to froth flotation process to enhances the efficiency of the froth flotation process.

A further object of the present invention is to propose an improved frothing agent adaptable to froth flotation process to enhance the efficiency of forth flotation process and coal selectivity which is capable to separate very fine particles of coal.

A still further object of the present invention is to propose an improved frothing agent adaptable to froth floatation process to enhance the efficiency of forth flotation process and coal selectivity which performs dual function i.e. frothers and collectors.

An yet further object of the present invention is to propose an improved frothing agent adaptabale to froth flotation process to enhance the efficiency of forth flotation process and coal selectivity which is less costly and Eco-friendly.

SUMMARY OF THE INVENTION

The present invention is directed to a froth flotation process for beneficiating coal wherein solid coal particles art selectively separated under coal froth flotation conditions as a froth phase from remaining solid feed particles as an aqueous phase in the presence of a frother. The improvement in such process is characterized by a frother comprising a blended mixture of ester, ketone molecules and epoxide conditioner.

According to the process of the present invention the frother thereof is used in a dosage ranging from between about 0.1 to about 0.2 kg/t of fine coal of less than ½ mm size.

A further object of the present invention is that the frother may be added to froth flotation process together with additional collectors, promoters and/or other frothers. The additional collectors are selected from the group consisting of fuel oils, polymers and esters. These additional collectors are used in a dosage ranging from between about 0.175 to about 0.350 kg/ton of coal.

The present invention has additional detailed features which shall be further described below.

DETAILED DESCRIPTION OF THE INVENTION

The improved frothing agent of the present invention is preferably used in the following composition as shown in Table 1.

TABLE 1

| Chemicals | Wt % in mixed frother |
|---|---|
| 2,6-Dimethyl-4-Heptanone | 85-89% |
| Tetrahydrofurfuryl acetate | 10-12% |
| 1,2,epoxydodecane | 0.25-.30% |
| Water | 4.75-5.25% |

A flotation cell of Denver D-12, 2.5-lit capacity is used for flotation test. This unit has a baffle arrangement at bottom to avoid swirling of the slurry within the cell and an impeller is provided for proper mixing of slurry, the speed of which can be controlled by a speed regulator. A compressor is also provided to supply air to the cell in the range of 0-2-1 pm in an interval of 11 pm. The cell has an automatic pulp level controller through make up water tank and froth removal system.

For each batch flotation, 250 gms of coal sample are allowed to wet for 1 hour in known volume of water. It is transferred into the 2.5-liter capacity Denver cell. Additional water is added to maintain required pulp density i.e. 10-14% solid content. Slurry is allowed to wet for 3 minutes at the impeller speed of 850 rpm. Then high speed diesel oil (collector) is added and conditioned for 3 minutes. After conditioning, requisite amount of frother is added. It is again conditioned for another 3 minutes. The cell is filled with water up to the marked height; air inlet valve is opened and kept at 21 pm. The froth samples are collected after 30, 60, 120 and 240 seconds of flotation. After the final froth samples is collected, the machine is stopped. The froth products and tailings (the part that remained inside the machine) is dried, weighed and analyzed for their ash content.

Example

A representative minus 0.5 mm size semi bituminous flotation feed coal sample is taken in this investigation. Nature of coal sample is difficult to float. Ash analysis is carried out according to ASTM D 3174-73 standard shows that the sample contains 24.5% ash. Sizewise weight and ash distribution analysis is conducted with a representative sample of the flotation feed. The flotation feed contains high percentage (20%) of oversize fraction, namely −1+0.5 mm, having 23.5% ash. Ultra size fraction of −0.075 mm is having maximum weight contribution in flotation feed content approx 50%. The conventional frother used for purposes of comparison is methyl isobutyl carbinol (MIBC. The aforementioned improved frothing agent of the present invention is compared against MIBC. Flotation yield for different clean coal is shown in FIG. 1. The results for each frother are given in the optimum frother and collector dosage with experimental variation.

Test Result

Figure 1:
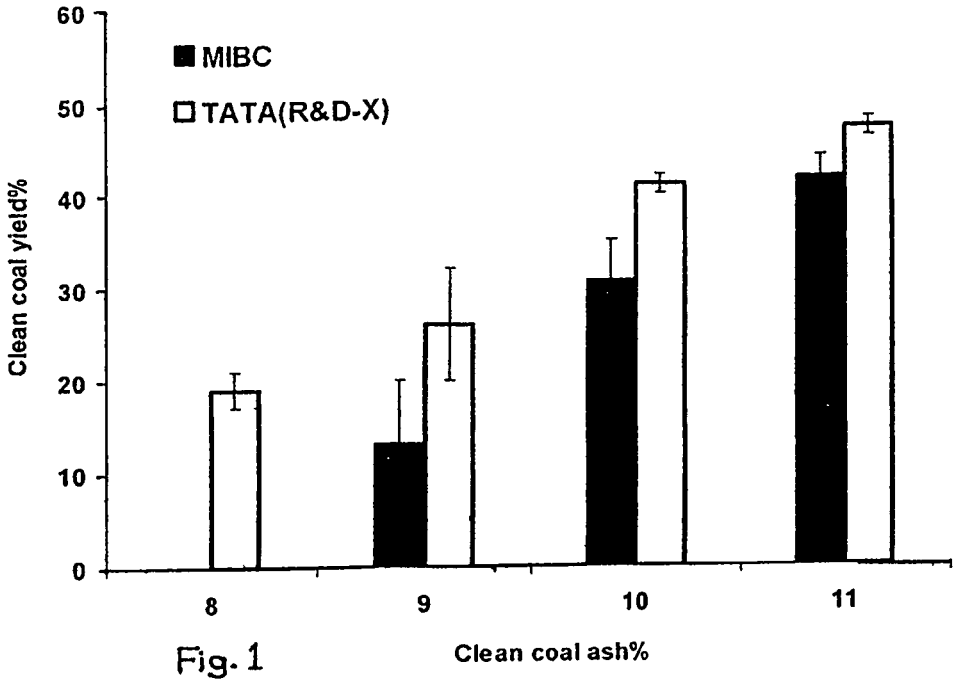
FIG. 1 shows the Improved frother is capable to produce low ash content (8%) clean coat compare to MIBC. It reflects that at each clean coal ash content, improved frother is producing higher clean coal yield compare to MIBC.
Figure 2:
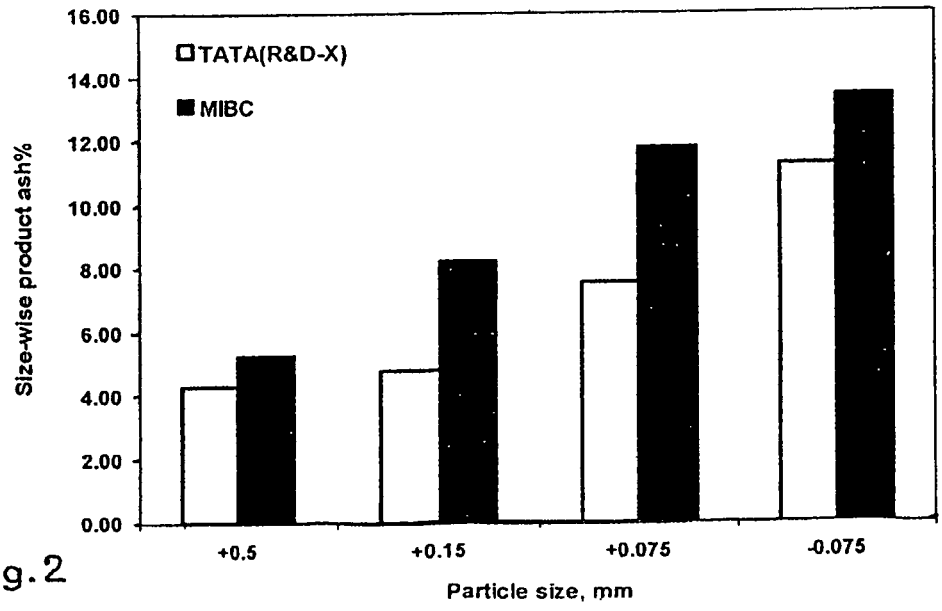
FIG. 2 is showing the sizewise clean coal ash % for different particle size of froth product. It reflects that for all size fractions (from coarse to ultrafine fraction) improved frother of the present invention is produced clean coal with better selectivity compare to MIBC.
Figure 3:
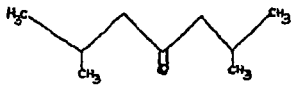
FIG. 3 shows the chemical structure of Table 1.
Figure 3:
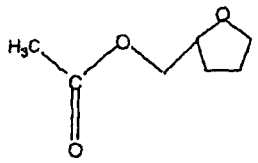
Figure 3:
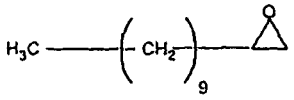
Figure 3:
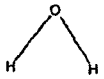

We claim:

1. An improved frothing agent adaptable to a froth flotation process to enhance coal selectivity for separation and efficiency of the forth flotation process comprising:

a Ketone comprising 2,6-Dimethyl-4-Heptanone 85-89% (Wt %);

Ester molecule comprising Tetrahydrofurfuryl Acetate 10-12% (Wt %);

Epoxide conditioner comprising 1,2-Epoxydodecane 0.25-0.30% (Wt %); and

Water 4.75-5.25% (Wt %).

2. The frothing agent as claimed in claim 1, wherein solid coal particles are selectively separated under coal froth flotation condition as a froth phase from remaining solid feed particles as an aqueous phase in the presence of said frothing agent.

3. The frothing agent as claimed in claim 1 wherein the said frothing agent is used in a dosage ranging between about 0.10 to about 0.2 kg/ton of coal.

4. The frothing agent as claimed in claim 1 wherein improvement of clean coal yield is 5-7% at low ash level as compare to commercial frother.

5. A process for selectively separating solid coal particles under coal froth flotation conditions comprising adding to a coal froth floatation process a frothing agent comprising 2,6-Dimethyl-4-Heptanone;

Tetrahydrofurfuryl Acetate;

1,2-Epoxydodecane; and

Water.

6. The process of claim 5, further comprising adding one or more of additional collectors, promoters and other frothing agents.

7. The process of claim 5, wherein the frothing agent comprises 85-89 wt % 2,6-Dimethyl-4-Heptanone;

10-12 wt % Tetrahydrofurfuryl Acetate;

0.25-0.30 wt % 1,2-Epoxydodecane; and 4.75-5.25 wt % Water.

8. The process of claim 5, wherein the frothing agent is added in an amount ranging from between about 0.1 to about 0.2 kg/t of coal.

9. The process of claim 6, wherein the additional collectors is selected from the group consisting of fuel oils, polymers and esters.

* * * * *